US006616070B1

(12) United States Patent
Kunkulagunta

(10) Patent No.: US 6,616,070 B1
(45) Date of Patent: Sep. 9, 2003

(54) FUEL INJECTOR

(75) Inventor: Koteswara Rao Kunkulagunta, Rainham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/603,441

(22) Filed: Jun. 23, 2000

(30) Foreign Application Priority Data

Jun. 24, 1999 (GB) ..... 9914644

(51) Int. Cl.[7] ..... F02M 61/00

(52) U.S. Cl. ..... 239/533.12; 239/533.2; 239/533.3; 239/533.9; 239/533.11; 239/584; 239/585.1

(58) Field of Search ..... 239/533.2, 533.3, 239/533.4, 533.9, 533.11, 533.12, 585.1, 585.2, 585.3, 585.4, 585.5, 583, 584

(56) References Cited

U.S. PATENT DOCUMENTS 4,151,958 A * 5/1979 Hofmann ..... 239/533.3
4,202,500 A * 5/1980 Keiczek ..... 239/533.3
4,284,043 A * 8/1981 Happel ..... 239/533.2 X
4,382,554 A * 5/1983 Hofmann ..... 239/533.9
4,407,457 A * 10/1983 Seifert ..... 239/533.12
4,658,824 A * 4/1987 Scheibe ..... 239/533.4 X
5,899,389 A * 5/1999 Pataki et al. ..... 239/533.2
6,338,445 B1 * 1/2002 Lambert et al. ..... 239/533.12
6,378,503 B1 * 4/2002 Lambert ..... 239/533.12

FOREIGN PATENT DOCUMENTS

| | | |
|---|---|---|
| EP | 0967382 | 12/1999 |
| JP | 07324661 | 12/1995 |
| WO | 8706308 | 10/1987 |

* cited by examiner

*Primary Examiner*—Robin O. Evans
(74) *Attorney, Agent, or Firm*—Thomas N. Twomey

(57) ABSTRACT

A fuel injector comprising an outer valve needle provided with a bore, an inner valve needle slidable within the bore, the outer and inner valve needles being engageable with first and second seatings respectively to control the supply of fuel from the fuel injector. The inner valve needle includes a passage which communicates with a sac chamber located downstream of the second seating, whereby movement of the outer valve needle away from the first seating causes fuel to flow through the passage into the sac chamber such that fuel pressure within the sac chamber causes the inner valve needle to lift away from the second seating.

15 Claims, 1 Drawing Sheet

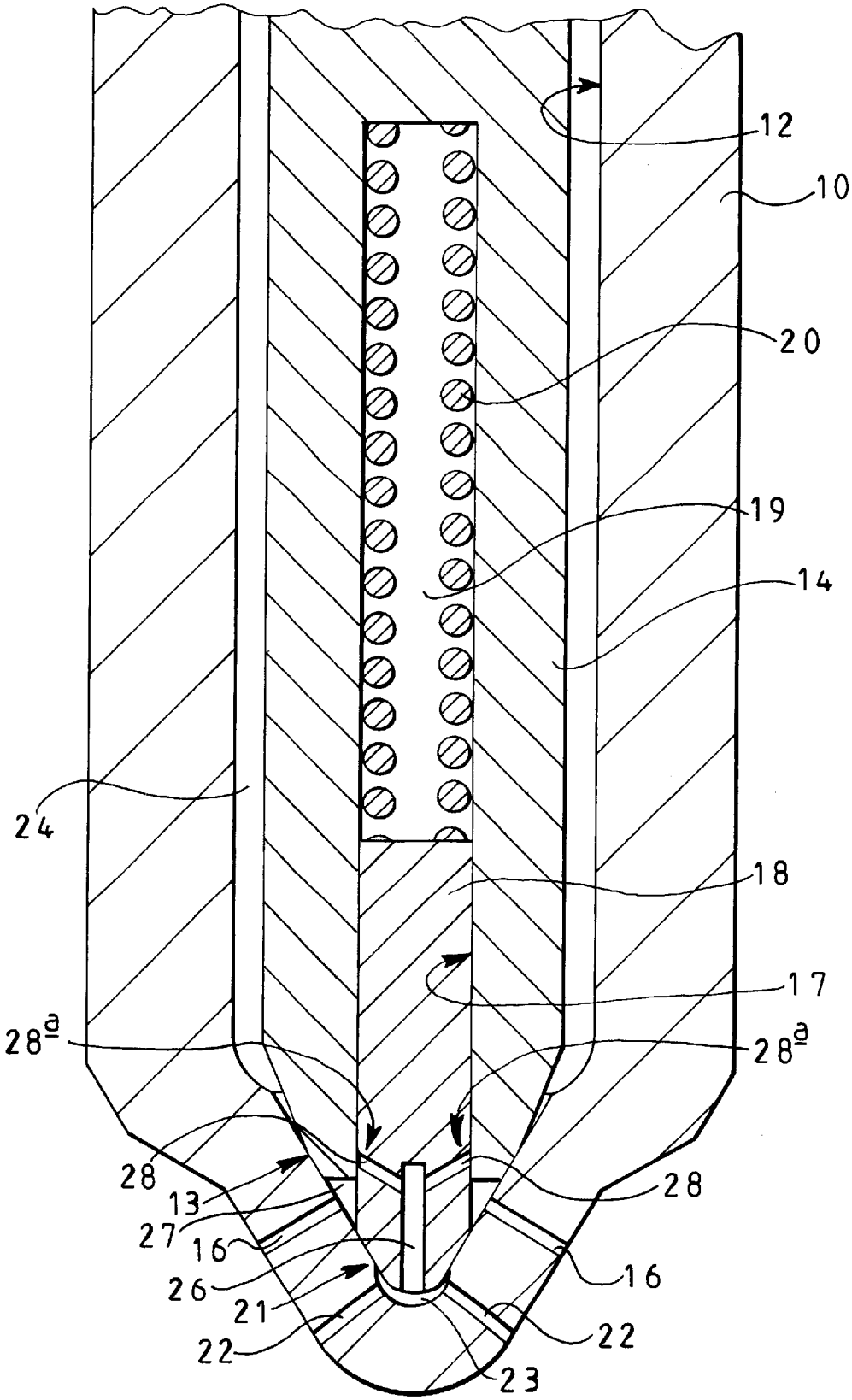
12
10
20
19
14
24
18
17
28a
28a
28
28
13
27
16
16
26
21
22
22
23

FUEL INJECTOR

TECHNICAL FIELD

This invention relates to a fuel injector for use in supplying fuel, under pressure, to a combustion space of a compression ignition internal combustion engine.

BACKGROUND OF THE INVENTION

In order to reduce emissions levels, it is known to provide fuel injectors in which the total area of the openings through which fuel is delivered can be varied, in use. One technique for achieving this is to use two valve needles, an outer valve needle which is slidable within a bore formed in a nozzle body and an inner valve needle which is slidable within a bore provided in the outer valve needle. Movement of the outer valve needle controls the supply of fuel to some of the outlet openings formed in the nozzle body, whereas movement of the inner valve needle controls the supply of fuel to other outlet openings formed in the nozzle body.

European patent application EP 99304430.4 describes a fuel injector of the aforementioned type in which movement of both the inner and outer valve needles is controlled by a single actuator. The bore in the outer valve needle is provided with a step which is engageable with an enlarged upper end region of the inner valve needle. In use, when the outer valve needle is lifted in an upwards direction away from a first valve seating by a relatively small amount, a first set of outlet openings are exposed, causing fuel to be ejected therefrom. Upward movement of the outer valve needle by a further amount causes the inner valve needle to engage the step such that movement of the outer valve needle is transmitted to the inner valve needle. This causes the inner valve needle to lift away from a second seating, exposing a second set of outlet openings from which fuel is then ejected. This provides a higher fuel delivery rate.

DESCRIPTION OF THE PREFERRED EMBODIMENT

It is an object of the invention to provide a fuel injector in which movement of the outer valve needle is transmitted to the inner valve needle by alternative means.

According to the present invention there is provided a fuel injector comprising an outer valve needle provided with a bore, an inner valve needle slidable within the bore, the outer and inner valve needles being engageable with first and second seatings respectively to control the supply of fuel from the fuel injector, the inner valve needle having a passage formed therein communicating with a sac chamber located downstream of the second seating, whereby movement of the outer valve needle away from the first seating causes fuel to flow through the passage into the sac chamber such that fuel pressure within the chamber causes the inner valve needle to lift away from the second seating.

Conveniently, initial movement of the outer valve needle away from the first seating by a relatively small amount to a first fuel injecting position causes a first set of outlet openings to be exposed from which fuel is then ejected, and further movement of the outer valve needle to a second fuel injecting position causes inner valve needle movement away from the second seating, thereby causing a second set of outlet openings to be exposed from which fuel is then ejected. By transmitting movement of the outer valve needle to the inner valve needle solely by increasing the fuel pressure within the sac chamber, the fuel injector is caused to move into a relatively stable second fuel injecting position. This provides an advantage over known fuel injectors in which the second fuel injecting position can be relatively unstable.

Conveniently, the outer valve needle is slidable within a further bore provided in a nozzle body and the inner valve needle may be provided with an axially extending passage communicating with one or more radially extending passages provided in the inner valve needle, movement of the outer valve needle within the further bore away from the first seating causing the end of the or each radially extending passage to be exposed to permit fuel to flow into the sac chamber.

The invention will now be described, by way of example only, with reference to the accompanying drawing, in which there is shown a sectional view of a fuel injector in accordance with the present invention.

Referring to the accompanying drawing, the fuel injector includes a nozzle body 10 provided with a blind bore 12. Adjacent the blind end of the bore, the bore 12 is shaped to define a first seating 13 of substantially frusto-conical shape. An outer valve needle 14 is slidable within the bore 12, the outer valve needle 14 being engageable with the first seating 13 to control fuel flow through a first set of outlet openings 16. Although not illustrated in the accompanying drawing, the upper end of the outer valve needle 14 is shaped to be of diameter substantially equal to that of the adjacent part of the bore 12 so as to form a substantially fluid tight seal therewith and to guide the outer valve needle 14 for sliding movement within the bore 12. Additionally, a spring (not shown), or other biasing means, is located at the upper end of the outer valve needle 14 and serves to bias the outer valve needle 14 in a downwards direction against the first seating 13. Movement of the outer valve needle 14 in an upwards direction is controlled by means of an actuator arrangement (not shown) located at the upper end of the outer valve needle 14 such as, for example, an electromagnetic actuator arrangement.

The outer valve needle 14 is provided with an axially extending bore 17 within which an inner valve needle 18 is slidable. The blind end of the bore 17 defines, with an upper end of the inner valve needle member 18, a spring chamber 19 which houses a compression spring 20. The compression spring 20 biases the inner valve needle 18 in a downwards direction against a second seating 21, of substantially frusto-conical shape, defined by the blind end of the bore 12. The inner valve needle 18 is engageable with the second seating 21 to control fuel flow through a second set of outlet openings 22 downstream of the first set of outlet openings 16. A sac region or sac chamber 23 is defined by the blind end of the bore 12 and the end of the inner valve needle 18 remote from the spring chamber 19. A delivery chamber 24 is defined by the bore 12 and the outer surface of the outer valve needle 14.

The inner valve needle 18 is provided with an axially extending passage 26 which communicates with the sac region 23. The inner valve needle 18 is also provided with passages 28 which extend radially from the passage 26 such that, when the inner valve needle 18 and the outer valve needle 14 are seated against their respective seatings, the ends 28*a* of the passages 28 are closed by the bore 17.

In use, fuel is supplied to the delivery chamber 24 from a source of fuel under high pressure. With the outer valve needle 14 seated against the first seating 13 and the inner valve needle 18 seated against the second seating 21, it will be appreciated that fuel in the delivery chamber 24 is unable to flow past the first seating 13 into the chamber 27. Thus, fuel injection into the engine cylinder does not take place. If the actuator is energized such that the outer valve needle 14 is moved in an upwards direction by a relatively small mount, causing the outer valve needle 14 to be lifted from the first seating 13, fuel in the delivery chamber 24 is able to flow past the first seating 13 into the chamber 27 and through the first set of outlet openings 16. The inner valve needle 18 remains seated against the second seating 21 due to the force of the spring 20. As fuel is unable to flow past the second seating 21 into the sac region 23, fuel is not ejected from the second set of outlet openings 22. In such circumstances, it will therefore be appreciated that fuel injection occurs at a relatively low rate.

In order to cease fuel injection the actuator is de-energized, causing the outer valve needle 14 to move back against the first seating 13 under the action of the spring force applied at its upper end. Fuel in the delivery chamber 24 is then no longer able to flow past the first seating 13 into the chamber 27 and fuel injection does not take place.

Alternatively, from the first injecting position, in which the outer valve needle 14 is lifted away from the first seating 13 by a relatively small amount, the actuator may be energized such that the outer valve needle 14 is moved away from the first seating 13 by a further amount. This causes the ends 28*a* of the passages 28 to be exposed to fuel in the chamber 27, causing a small amount of fuel within the chamber 27 to flow through the passages 28, into the passage 26 and subsequently into the sac region 23. At this stage, a small amount of fuel is able to flow through the second group of outlet openings 22 into the engine cylinder.

Initially, as fuel flows into the sac region 23 through the relatively narrow passages 26, 28 provided in the inner valve needle 18, the amount of fuel ejected from the second group of outlet openings 22 will be relatively small. However, as fuel pressure increases within the sac region 23, an upwards force is applied to the inner valve needle 18 which opposes the spring force applied by the spring 20. When fuel pressure in the sac region 23 overcomes the spring force, the inner valve needle 18 is lifted away from the second seating 21. Fuel in the chambers 24,27 is therefore able to flow directly into the sac region 23 past the second seating 21 and, thus, out through the second group of outlet openings 22. At this stage, the rate of fuel injection through the second group of outlet openings 22 is increased. It will therefore be appreciated that fuel injection occurs at a relatively high rate.

In order to cease fuel injection, the actuator is de-energized, causing the outer valve needle 14 to move back against the first seating 13 under the spring force applied to its upper end. Downward movement of the outer valve needle 14 closes the ends 28*a* of the passages 28, preventing further fuel flow between the chamber 27 and the sac region 23. Thus, fuel pressure in the sac region 23 is reduced and the inner valve needle 18 moves downwardly under the action of the spring 20 to seat against the second seating 21. The inner and outer valve needles 18,14 therefore return to the seated positions shown in the accompanying drawing.

The inner valve needle 18 forms a substantially fluid tight seal with the bore 17, thus, in use, fuel is unable to flow to or from the spring chamber 19 or such a flow of fuel is limited to a very low rate. The spring chamber 19 is of relatively large volume. Thus, relative movement of the needles 14,18 has relatively little effect upon fuel pressure within the spring chamber 19, the effect being insufficient to impede operation of the injector.

It will be appreciated that alternative bias means may be provided, in place of the compression spring 20, to bias the inner valve needle 18 against the second seating 21. Additionally, it will be appreciated that additional passages may be provided in the inner valve needle 18 to increase the rate at which fuel flows from the chamber 27 into the sac region 23 as the outer valve needle 14 is lifted away from the first seating 13 and uncovers the ends 28*a* of the passages 28.

Each set of first and second outlet openings 16,22 may include more than two outlet openings. Alternatively, a single first outlet opening and a single second outlet opening may be provided.

What is claimed is:

1. A fuel injector comprising a nozzle body having a blind bore defining first and second seatings therein, an outer valve needle slidable within the blind bore between at least a first seated position and a second open position, the outer valve needle provided with a bore, an inner valve needle slideable within the outer valve needle bore, the outer and inner valve needles being selectively engageable with the first and second seatings respectively to control the supply of fuel from the fuel injector the inner valve needle having a passage formed therein communicating with a sac chamber defined by the inner valve needle and the nozzle body and located downstream of the second seating, the outer valve needle cutting off fuel flow through the passage into the sac chamber when in the first seated position and permitting pressurized fuel to flow through the passage into the sac chamber primarily exposing one end but not an opposite end of the inner valve needle to the pressurized fuel when the outer valve needle is in the second open position, and the inner valve needle being slidably responsive in the outer valve needle bore to lift away from the second seating in response to fuel pressure within the sac chamber.

2. The fuel injector as claimed in claim 1, wherein the injector is arranged such that initial movement of the outer valve needle away from the first seating by a relatively small amount to a first fuel injecting position causes a first set of outlet openings to be exposed from which fuel is then ejected, and further movement of the outer valve needle to a second fuel injecting position causes the inner valve needle to move away from the second seating, thereby causing a second set of outlet openings to be exposed from which fuel is then ejected.

3. The fuel injector as claimed in claim 1, wherein the inner valve needle is provided with an axially extending passage communicating with one or more radially extending passages provided in the inner valve needle.

4. The fuel injector as claimed in claim 3, wherein the outer valve needle is slidable within a further bore provided in a nozzle body, the injector being arranged such that movement of the outer valve needle within the further bore away from the first seating exposes the end of the or each radially extending passage to permit fuel to flow into the sac chamber.

5. The fuel injector as claimed in claim 1, further comprising a spring chamber for housing a spring which serves to urge the inner valve needle against the second seating.

6. The fuel injector as claimed in claim 5, wherein the inner valve needle is arranged within the outer valve needle such that the flow of fuel to or from the spring chamber is limited to a very low rate.

7. A fuel injector comprising an outer valve needle provided with a bore, an inner valve needle slideable within the bore, the outer and inner valve needles being engageable with first and second seatings respectively to control the supply of fuel from the fuel injector, the inner valve needle having a passage formed therein communicating with a sac chamber located downstream of the second seating, the outer valve needle being adapted to cut off fuel flow through the passage into the sac chamber when in contact with the first seating and to permit fuel to flow through the passage into the sac chamber when the outer valve needle is not in contact with the first seating, and the inner valve needle being adapted to lift away from the second seating in response to fuel pressure within the sac chamber, and further comprising a spring chamber for housing a spring which serves to urge the inner valve needle against the second seating wherein the inner valve needle forms a substantially fluid tight seal with the bore provided in the outer valve needle such that the flow of fuel to or from the spring chamber is substantially prevented.

8. A fuel injector comprising:

a nozzle body having a blind bore;

an outer valve needle slidable within the blind bore between at least a first seated position and a second open position, the outer valve needle having a bore;

a slideable inner valve needle located within the outer valve needle bore;

a first seating and a second seating defined by the blind bore and selectively engageable with the outer and inner valve needles; and a fuel sac chamber defined by the inner valve needle and the nozzle body and located downstream of the second seating and in communication with the inner valve needle;

the outer valve needle cutting off fuel flow into the sac chamber when in the first seated position and permitting fuel to flow into the fuel sac chamber exposing only one end of the inner valve needle to the pressurized fuel when the outer valve needle is in the second open position, thereby increasing fuel pressure within the fuel sac chamber wherein the inner valve needle is slidably responsive to the fuel pressure to lift away from the second seating.

9. A fuel injector comprising:

a nozzle body provided with a bore and having a first set of exit orifices, a second set of exit orifices and a sac chamber;

an outer valve needle provided with a bore defined by an inner wall and moveable within said nozzle body bore between a shut-off position, a first open position and a second open position;

an inner valve needle provided with an axial passage and a radial passage, said inner valve needle moveable within said outer valve needle bore between a closed position and an open position;

the outer valve needle blocking said first set of exit orifices and the inner wall preventing fuel flow through said axial and radial passages into the sac chamber when in the shut off position, the inner wall exposing the radial passage and permitting fuel to flow to said first set of exit orifices when the outer valve needle is in said first open position and thereby permitting fuel to flow through said first set of exit orifices, said radial passage, said axial passage, said sac chamber and said second set of exit orifices at a first flow rate when in said second open position, the inner valve needle primarily having one end but not an opposite end of the inner valve needle exposed to the pressurized fuel and being slidably responsive to move from said closed position to said open position in response to fuel pressure within said sac chamber, the inner and outer valve needles thereby permitting fuel to bypass said radial and axial passages and flow through said second set of exit orifices when the inner valve needle is in said open position.

10. The fuel injector as claimed in claim 9 wherein said sac chamber is downstream from said first set of exit orifices and said second set of exit orifices.

11. The fuel injector as claimed in claim 9, further comprising a spring chamber for housing a spring which serves to urge said inner valve needle in said closed position.

12. The fuel injector as claimed in claim 11, wherein said inner valve needle is arranged within said outer valve needle valve bore such that the flow of fuel to or from said spring chamber is limited to a very low rate.

13. A fuel injector comprising:

a nozzle body provided with a bore and having a first set of exit orifices, a second set of exit orifices and a sac chamber;

an outer valve needle provided with a bore and moveable within said nozzle body bore between a shut-off position, a first open position and a second open position;

an inner valve needle provided with an axial passage and a radial passage, said inner valve needle moveable within said outer valve needle bore between a closed position and an open position;

the outer valve needle being adapted to cutoff fuel flow through said axial and radial passages into the sac chamber when in the shut off position, to permit fuel to flow to said first set of exit orifices when in said first open position and to permit fuel to flow through said first set of exit orifices, said radial passage, said axial passage, said sac chamber and said second set of exit orifices at a first flow rate when in said second open position, the inner valve needle being adapted to move from said closed position to said open position in response to fuel pressure within said sac chamber, and the inner and outer valve needles being adapted to permit fuel to bypass said radial and axial passages and flow through said second set of exit orifices when the inner valve needle is in said open position and further comprising a spring chamber for housing a spring which serves to urge said inner valve needle in said closed position wherein said inner valve needle forms a substantially fluid tight seal with the outer valve needle bore such that the flow of fuel to or from said spring chamber is substantially prevented.

14. A fuel injector comprising an outer valve needle provided with a bore and an inner valve needle slidable within the bore, the outer and inner valve needles being engageable with first and second seating, respectively, to control the supply of fuel from the fuel injector, the inner valve needle having a passage formed therein communicating with a sac chamber located downstream of the second seating, and the outer valve needle having means for selectively closing the passage, wherein movement of the outer valve needle away from the first seating opens the passage, thereby to permit fuel to flow through the passage into the sac chamber exposing only one end of the inner valve needle to pressurized fuel such that fuel pressure within the sac chamber causes the inner valve needle to lift away from the second seating.

15. A fuel injector comprising an outer valve needle provided with a bore and an inner valve needle slidable within the bore, the outer and inner valve needles being engageable with first and second seatings, respectively, to control the supply of fuel from the fuel injector, the inner valve needle having a passage formed therein communicating with a sac chamber located downstream of the second seating, wherein substantially no fuel flows into the sac chamber when the outer valve needle is engaged with the first seating and wherein movement of the outer valve needle away from the first seating causes fuel to flow through the passage into the sac chamber exposing only one end of the inner valve needle to pressurized fuel such that fuel pressure within the sac chamber causes the inner valve needle to lift away from the second seating.

* * * * *